US011324277B2

(12) United States Patent
Thomas et al.

(10) Patent No.: US 11,324,277 B2
(45) Date of Patent: May 10, 2022

(54) FOOTWEAR SPIKE WRENCH HAVING ADJUSTABLE DIRT REMOVAL PRONG

(71) Applicant: Spikebuddy LLC, Leesburg, VA (US)

(72) Inventors: Luke T Thomas, Leesburg, VA (US); Thomas K Thomas, Leesburg, VA (US)

( * ) Notice: Subject to any disclaimer, the term of this patent is extended or adjusted under 35 U.S.C. 154(b) by 124 days.

(21) Appl. No.: 16/760,574

(22) PCT Filed: Jan. 25, 2019

(86) PCT No.: PCT/US2019/015188

§ 371 (c)(1),
(2) Date: Apr. 30, 2020

(87) PCT Pub. No.: WO2019/147962

PCT Pub. Date: Aug. 1, 2019

(65) Prior Publication Data

US 2020/0345099 A1 Nov. 5, 2020

Related U.S. Application Data

(60) Provisional application No. 62/623,513, filed on Jan. 29, 2018.

(51) Int. Cl.

| | |
|---|---|
| ***A63B 57/60*** | (2015.01) |
| ***B25G 1/08*** | (2006.01) |
| ***B25B 13/48*** | (2006.01) |
| ***B25D 7/00*** | (2006.01) |
| ***B25F 1/02*** | (2006.01) |

(Continued)

(52) U.S. Cl.

CPC ..... *A43B 5/001* (2013.01); *A63B 57/60* (2015.10); *B25B 13/48* (2013.01); *B25D 7/00* (2013.01); *B25F 1/02* (2013.01); *B25G 1/06* (2013.01); *B25G 1/08* (2013.01); *A43B 5/06* (2013.01); *A43C 15/161* (2013.01)

(58) Field of Classification Search

CPC ... B25F 1/00; B25F 1/02; A43B 5/001; A43B 5/06; A63B 57/60; B25G 1/06; B25G 1/08; B25B 13/48; B25D 7/00

See application file for complete search history.

(56) References Cited

U.S. PATENT DOCUMENTS

| | | | |
|---|---|---|---|
| 4,262,562 | A | 4/1981 | MacNeill |
| 4,679,468 | A | 7/1987 | Gray |

(Continued)

FOREIGN PATENT DOCUMENTS

| | | | |
|---|---|---|---|
| WO | 9101777 | A1 | 2/1991 |

OTHER PUBLICATIONS

PGA Tour Golf Multi Tool—PGAT36 (Second chance Limited) Aug. 14, 2013: https://www.youtube.com/watch?V=olC3zbEiUTw>.

*Primary Examiner* — David B. Thomas
(74) *Attorney, Agent, or Firm* — Joan K. Lawrence

(57) ABSTRACT

An all-in-one footwear spike wrench and dirt removal tool includes a footwear spike wrench key and also a footwear dirt removal prong. The prong is adjustable between a stored position in which the prong is inoperative and a deployed position in which the prong is operative. The tool may include a compartment configured and dimensioned for storing running spikes. A tool kit includes the tool, a separate wrench key bit and a separate dirt removal prong bit, the latter two being selectively retained in a base member of the tool.

17 Claims, 18 Drawing Sheets

(51) Int. Cl.

| | |
|---|---|
| ***B25G 1/06*** | (2006.01) |
| ***A43B 5/00*** | (2022.01) |
| *A43B 5/06* | (2022.01) |
| *A43C 15/16* | (2006.01) |

(56) References Cited

U.S. PATENT DOCUMENTS

| | | | | | |
|---|---|---|---|---|---|
| 5,048,138 | A | | 9/1991 | Everroad | |
| 5,226,647 | A | | 7/1993 | Notarmuzi | |
| 5,386,605 | A | * | 2/1995 | Murphy | B25B 13/56 7/138 |
| 5,497,523 | A | | 3/1996 | Tarnoff | |
| 5,551,111 | A | * | 9/1996 | Murphy | B25B 13/50 7/138 |
| 5,875,694 | A | * | 3/1999 | Graf | B25B 13/50 81/461 |
| 5,887,496 | A | * | 3/1999 | Pollard | B25B 13/50 81/461 |
| 6,053,078 | A | * | 4/2000 | Parker | B25B 13/50 81/461 |
| 6,161,456 | A | * | 12/2000 | Langford | B25B 23/005 81/461 |
| 6,170,364 | B1 | * | 1/2001 | Johnson | B25B 13/48 81/120 |
| 6,595,091 | B2 | * | 7/2003 | Williams | B25B 13/48 81/177.4 |
| 7,131,357 | B2 | * | 11/2006 | Wolf | B25B 13/48 81/437 |
| 2002/0178878 | A1 | | 12/2002 | Williams | |
| 2005/0005740 | A1 | | 1/2005 | Wolf | |

* cited by examiner

FOOTWEAR SPIKE WRENCH HAVING ADJUSTABLE DIRT REMOVAL PRONG

RELATED APPLICATIONS

The present application claims priority to U.S. Provisional patent application No. 62/623,513 filed Jan. 29, 2018. The contents of the aforementioned application are incorporated by reference in their entirety.

FIELD OF THE INVENTION

The present application relates to hand-held footwear tools for the installation and removal of spikes from the sole of sports footwear. It is particularly directed to a tool having both a spike removal wrench key and an integrated dirt removal prong suitable for removing dirt from spikes.

BACKGROUND OF THE INVENTION

In the sport of Cross Country, runners use special footwear with "spikes" which is designed to increase traction across terrain that is seen on various courses. The spikes come in a variety of different sizes, depending on the course type. Spiked running shoes come with metal spikes of ⅛-¼ inch that are screwed into designated holes in the bottom of the shoes. These spikes are installed into the shoe prior to the race with a spike wrench.

There is a common issue that many runners face when they try to install or remove the spike. When runners arrive at a cross country race, they typically need to switch their spikes with one that has the appropriate length to adjust to the terrain they will be running on. Very often, there is dirt and mud that is caked and solidified into the bottom of the shoes and spikes from their previous race that makes it impossible to remove and replace the spikes. Today, some cross country runners are using table forks, screwdrivers and other household tools to remove this dirt.

Similarly, in the sport of golf, after every round, golfers often struggle to remove grass and dirt that accumulates in the spikes. Golfers have been seen using a hard brush, a golf tee or divot tools to remove grass and dirt.

What is needed is an inexpensive tool which can be used for both spike removal and dirt removal.

SUMMARY

This invention relates to a tool for attaching and removing spikes to and from the sole of sports footwear, and also for removing dirt from the vicinity of the spikes. The tool includes a spike key and a dirt removal prong. The prong is configured and dimensioned to allow for maximum removal of dirt from spikes, cleats, treads, and other formations on the bottom sole of the sports footwear. More particularly, the prong is sharp and pointed so that it can be used to pick at dirt which has accumulated around the base on spikes and even in recessed areas of the spikes and soles of the shoes.

In some embodiments, the prong is configured to selectively occupy either a stored inactive position or to a deployed active position. When the prong is in the stored inactive position, it allows for safe transportation with no damage to other contents it is carried with. When it is deployed in the active position, the integrated prong exposes its sharp and pointed structure and effectively removes dirt and other formations from spikes and from the bottom sole of the sports footwear.

The subject matter of the present application may be described with reference to the following paragraphs.

Paragraph 1—In one aspect, the subject matter of the present application is directed to an all-in-one footwear spike wrench and dirt removal tool comprising:

a handle member; a base member connected to the handle member; a footwear spike wrench key attached to an end of the base member; and a footwear dirt removal prong attached to at least one of the handle member and the base member, the prong having a terminal end configured for removing dirt from a vicinity of a footwear spike. The prong is adjustable between: (i) a stored position in which the terminal end is inoperative for removing dirt; and (ii) a deployed position in which the terminal end is operative for removing dirt.

The all-in-one-tool may also include the features in Paragraphs 2-4 in any combination:

Paragraph 2—The prong may comprise a tapered tool portion having a cross-sectional area that decreases in a direction from a base end thereof to the terminal end.

Paragraph 3—The length of the tapered tool portion is between 3 cm and 5 cm; the width at the base end of the tapered tool portion is between 5 mm and 10 mm; and a maximum cross-sectional area of the tapered tool portion is 5 $mm^2$.

Paragraph 4—The prong's tapered tool portion may be made of metal.

Paragraph 5—In the tool of any of Paragraphs 1-4, the footwear spike wrench key may be configured to install and remove running spikes.

Paragraph 6—In the tool of any of Paragraphs 1-4, the footwear spike wrench key may be configured to install and remove golf spikes.

Paragraph 7—In the tool of any of Paragraphs 1-6, the prong may comprise a body portion having a first body end and a second body end; and a tool portion protruding from the first body end, the prong's terminal end belonging to the tool portion.

Paragraph 8—In the tool of Paragraph 7, the handle member may further comprise: an internal compartment having a compartment opening that opens out to a surface of the handle member; and a cap configured to selectively seal and unseal the compartment opening to provide access to the internal compartment; wherein: the internal compartment is configured and dimensioned to accommodate at least twelve standard cross-country running spikes.

Paragraph 9—In the tool of Paragraph 8, the base member may have sleeve formed therein; the footwear spike wrench key may protrude from the second body end of the body portion, such that the footwear spike wrench key and the prong's tool portion protrude from opposite ends of the body portion; in the stored position, the prong's tool portion is received into the base member's sleeve and inoperative while the footwear spike wrench key is exposed and operative; and in the deployed position, the prong's tool portion is exposed and operative, while the footwear spike wrench key is received into the base member's sleeve and inoperative.

Paragraph 10—In the tool of Paragraph 9, in both the stored and deployed positions, the body portion may be attached to the base member via a snap-fit.

Paragraph 11—in the tool of Paragraph 9, in both the stored and deployed positions, the body portion is threadingly attached to the base member.

Paragraph 12—In the tool of any of Paragraphs 1-6, the handle member may have a sleeve formed therein; the prong is connected to the handle member in the stored position; the prong may be connected to the base member in the deployed position; in the stored position, the tool portion may be received into the handle member's sleeve and inoperative, while the body portion's second body end is exposed; and in the deployed portion, the body portion may be mounted over the footwear spike wrench key, with the tool portion exposed and operative and the footwear spike wrench key inoperative.

Paragraph 13—In the tool of Paragraph 12, the prong may be threadingly mounted to the handle member, in stored position; and the prong may be threadingly mounted to the base member, in the deployed position.

Paragraph 14—In the tool of any of Paragraphs 1-6, the handle member may have a sleeve formed therein; the prong may be connected to the handle member in both the stored and deployed positions; in the stored position, the tool portion may be received into the handle member's sleeve and inoperative, while the body portion's second body end is exposed; and in the deployed portion, the tool portion may be exposed and operative, while the body portion's second body end faces the handle member's sleeve.

Paragraph 15—In the tool of Paragraph 14, the prong may be threadingly mounted to the handle member, in both the stored and deployed positions.

Paragraph 16—In the tool of any of Paragraphs 1-6, the base member may be connected to the handle member by a first hinge; the prong may be connected to the handle member by a second hinge; the prong may at least partially occupy a slot formed in the handle member, when the prong is in the stored position; and the prong may be pivoted about the second hinge, when the prong is adjusted from the stored position to the deployed position.

Paragraph 17—In another aspect, the subject matter of the present application is directed to a cross-country footwear spike and dirt removal kit, comprising: a footwear spike and dirt removal tool comprising a handle member and a base member connected to the handle member, the base member having a sleeve formed therein; a footwear spike wrench key configured to be selectively retained in the sleeve of the base member and operative; and a footwear dirt removal prong configured to be selectively retained in the sleeve of the base member and operative; wherein: only one of the footwear spike wrench key and the footwear dirt removal prong can be retained in the sleeve and operative at any given time, the other of the footwear spike wrench key and the footwear dirt removal prong being detached from the footwear spike and dirt removal tool.

In the kit of Paragraph 18, the handle member may further comprise an internal compartment having a compartment opening that opens out to a surface of the handle member; and a cap configured to selectively seal and unseal the compartment opening to provide access to the internal compartment; wherein: the internal compartment is configured and dimensioned to accommodate at least twelve standard cross-country running spikes.

DETAILED DESCRIPTION OF THE PREFERRED EMBODIMENTS

Figures 1, 2:
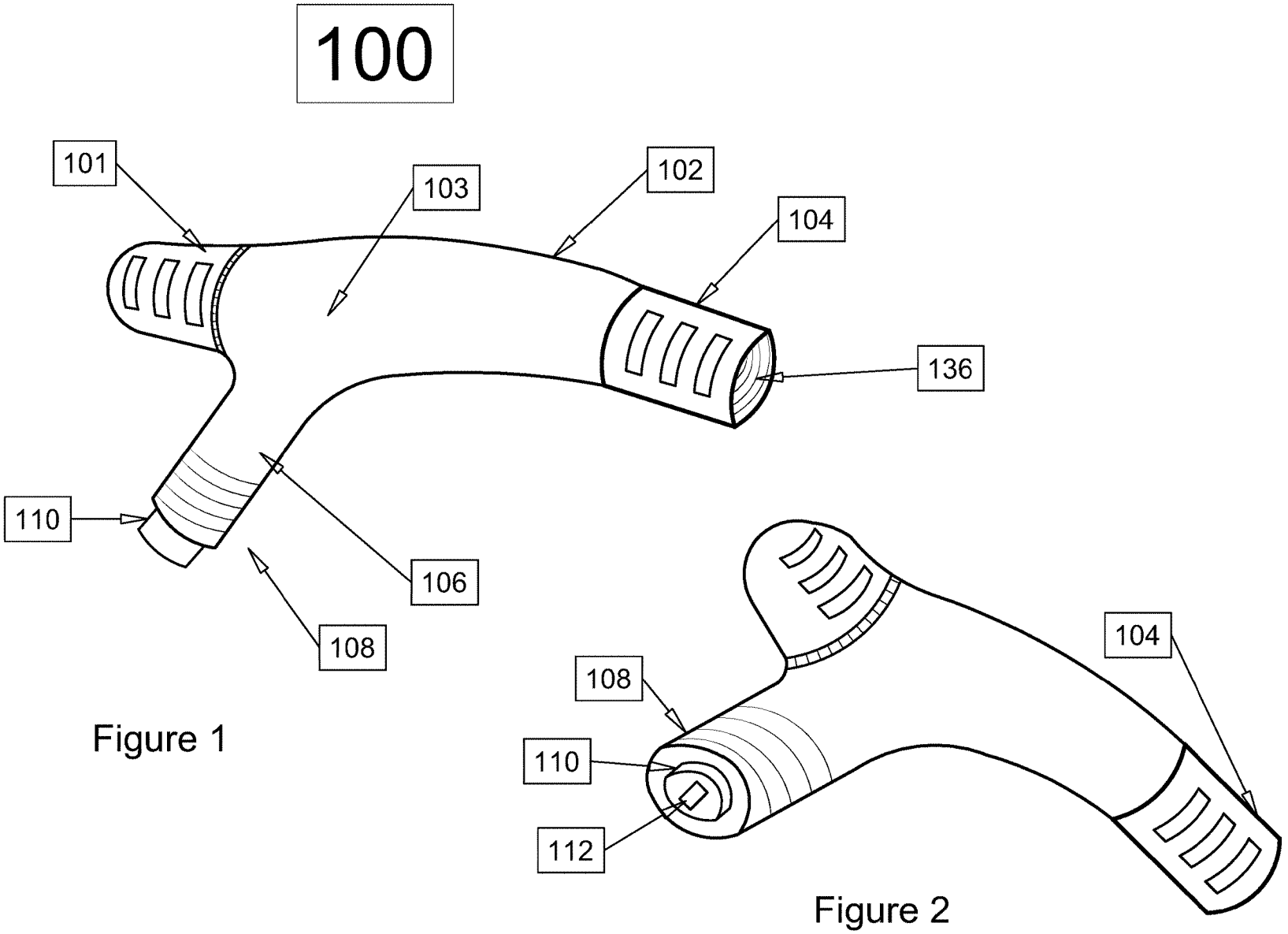
FIG. 1 and FIG. 2 is an elevational and perspective view of the footwear spike wrench and dirt removal tool respectively.

FIG. 1 is an elevational view of the footwear spike wrench and dirt removal tool (100) with a cylindrical body handle member (102). This tool has three key components; an angled bar base member (106) extending from the cylindrical body handle member (102) that leads to the spike wrench key (110), and a small portion (104) at the end of the cylindrical body handle member (102) that can be unscrewed, which will reveal the dirt removal prong within the body of the tool and another small cap (101) at the other end of the cylindrical body handle member (102) that can be unscrewed, allowing access to storage area (103) within the cylindrical body handle member (102) to house spikes. Along the base of the angled bar base member (106) that leads to the spike wrench key (110), there are grooves (108) that allows for placement of the dirt removal portion (104) on the angled bar base member (106) by screwing it into place over the spike wrench key (110).

FIG. 2 is a perspective view of the footwear spike wrench and dirt removal tool (100). In this figure, the bottom of the tool is clearly visible, revealing the spike wrench key (110). A closer view of the rectangular shape of the spike wrench keyhole can also be seen (112). It is designed to remove spikes from cross country footwear. It will be understood that this form of tool may utilize other spike wrench keys too such as those that are utilized for golf. In addition to this, the grooves above the spike wrench key are seen (108), which will be used to screw on the dirt removal portion of the tool (104).

Figure 3:
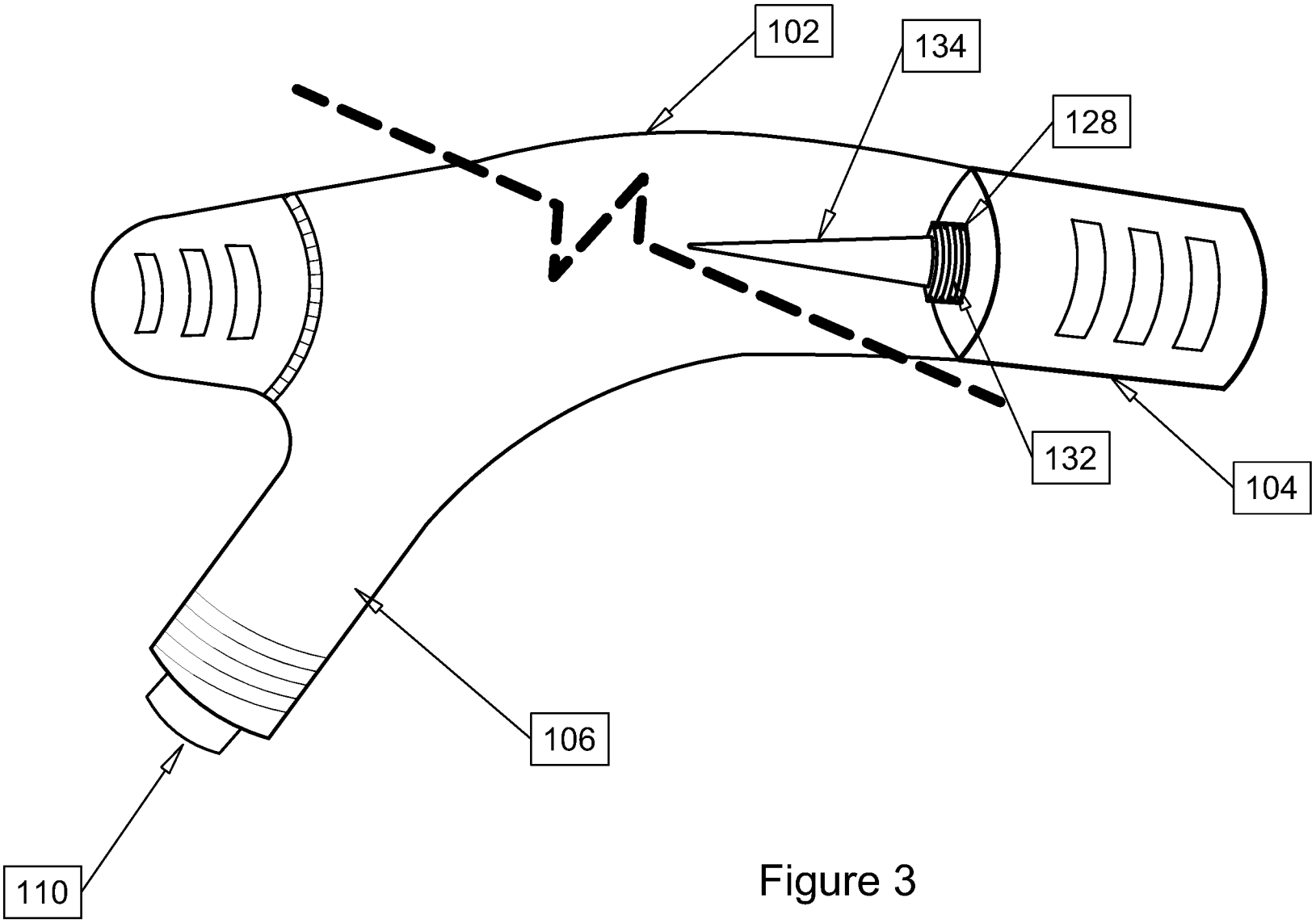
FIG. 3 is a sectional view of the footwear spike wrench and dirt removal tool with dirt removal prong engaged in its rest or stored position therewith, partly cut away.

FIG. 3 is a sectional view of the dirt removal prong of the footwear spike wrench and dirt removal tool (100) with a cylindrical body handle member (102). In this figure, the dirt removal prong (134) can be seen within the tool in its stored inactive position within the cylindrical body handle member (102). It has the ability to rest within the cylindrical body handle member (102) since the dirt removal portion of the tool (104) has a grooved surface (132) that allows for it to be screwed into another grooved surface in the body of the tool (128). The dirt removal portion of the tool (104) also has a grooved surface on its inner side (136), allowing for it to be able to be threadingly mounted over the spike wrench key (110) on the angled bar base member (106).

Figure 4:
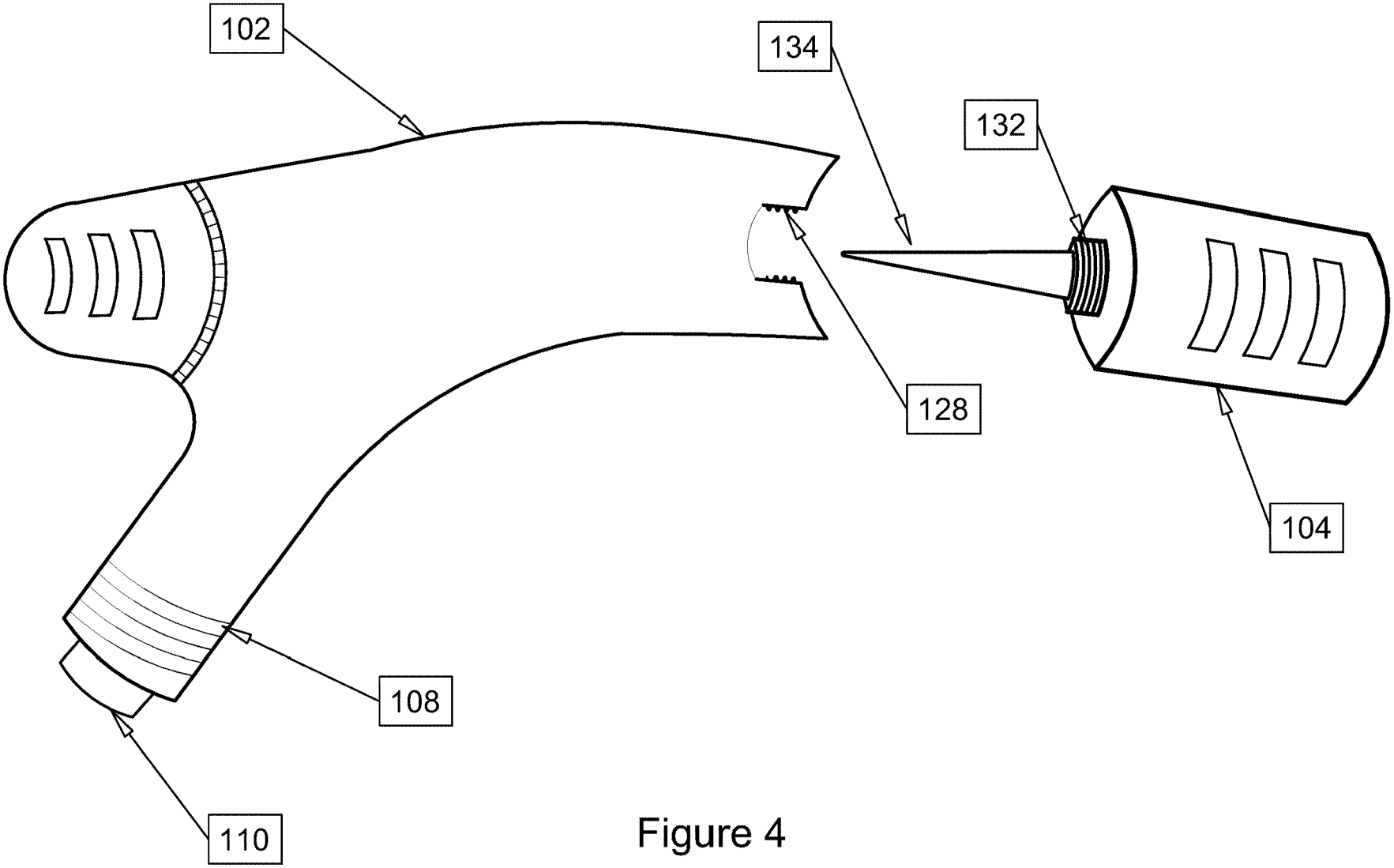
FIG. 4 is an elevational view of the footwear spike wrench and dirt removal tool, wherein the dirt removal portion of the tool, including the prong, is unscrewed from its rest or stored position within the handle member of the tool.

FIG. 4 is an elevational view of the footwear spike wrench and dirt removal tool (100), wherein the dirt removal portion of the tool (104), including the prong (134), is unscrewed from its stored inactive position within the body of the tool, revealing the grooved edge (128) within the cylindrical body handle member (102), as well as the grooved edge of the dirt removal piece (132). This figure shows these two parts, when screwed together, result in one complete cylindrical body handle member (102) for the footwear spike wrench and dirt removal tool.

Figure 5:
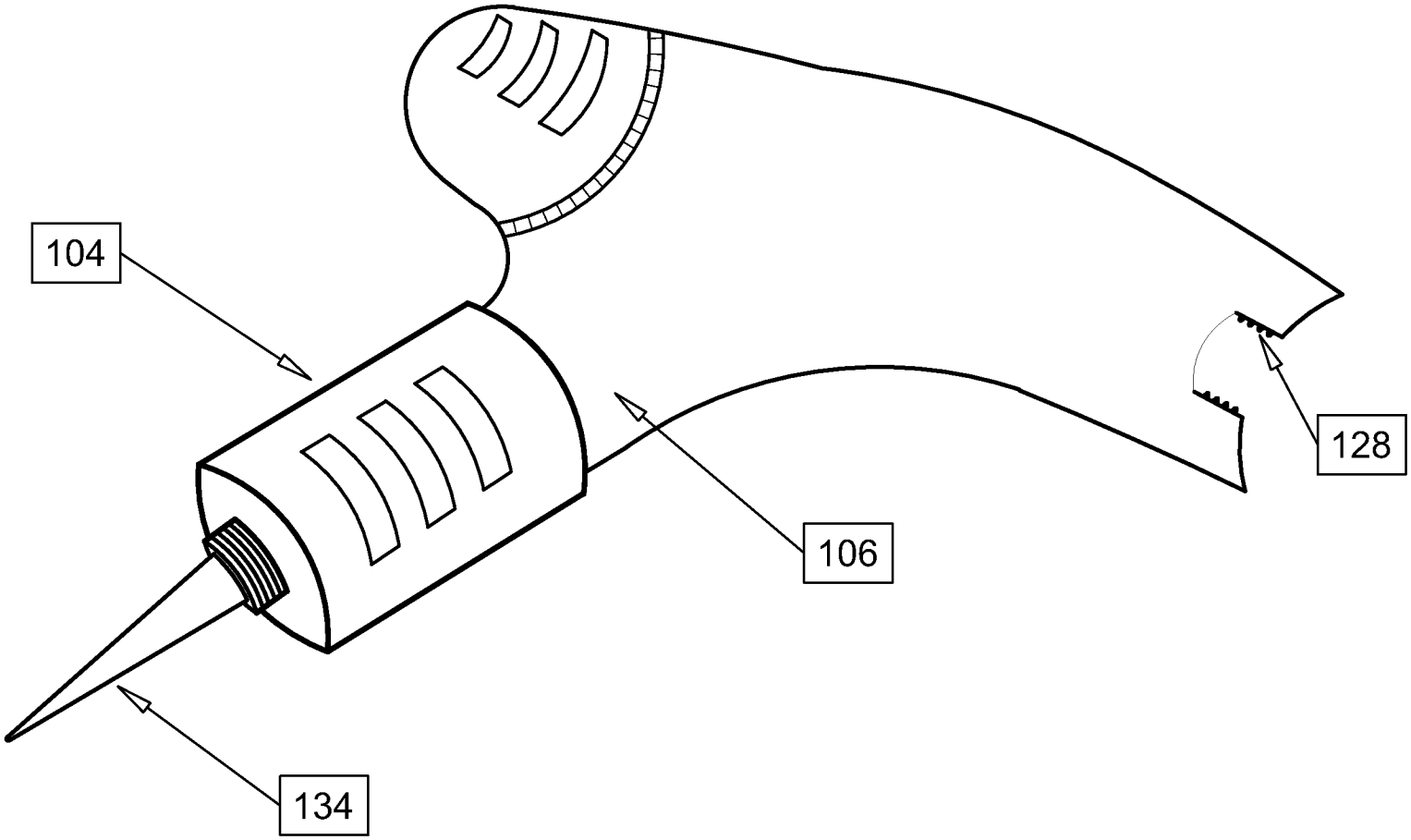
FIG. 5 is an elevational view of the footwear spike wrench and dirt removal tool wherein the dirt removal portion of the tool, including the prong, is threaded or attached over the spike wrench onto the base member in its deployed active working position.
Figure 6:
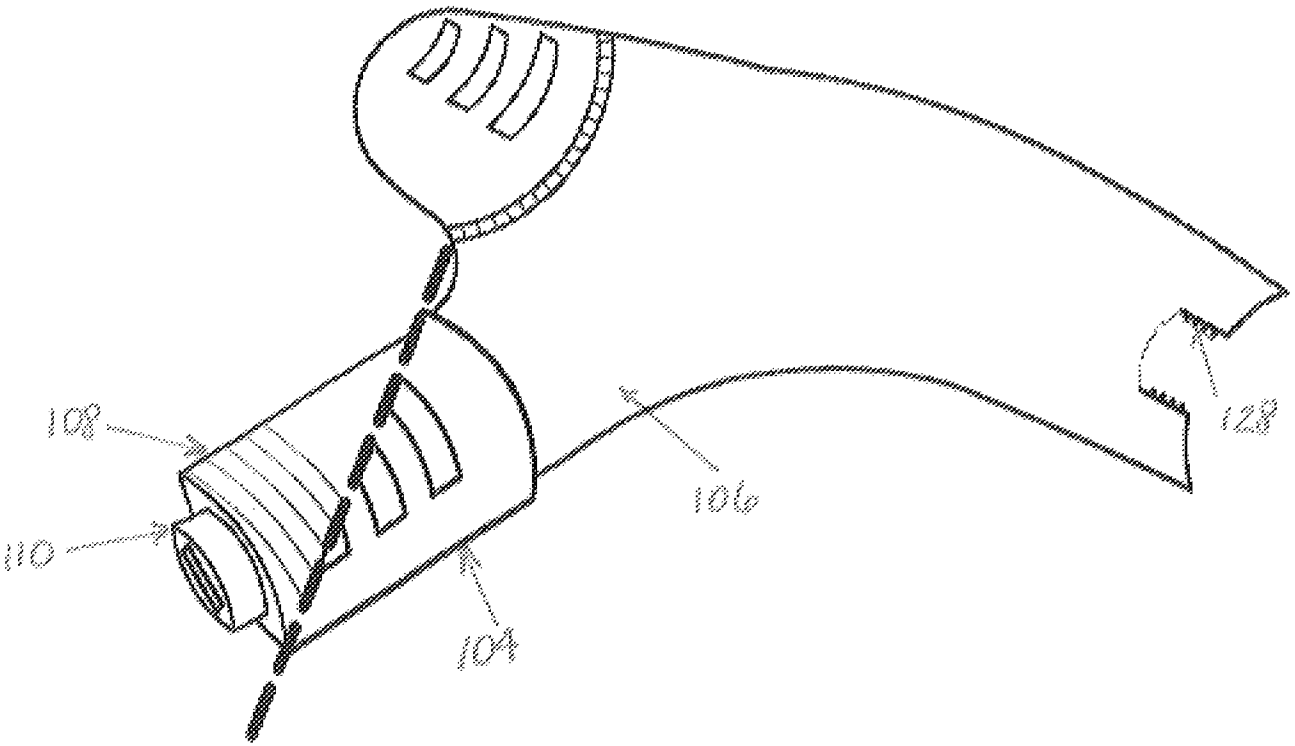
FIG. 6 is a sectional view of the footwear spike wrench and dirt removal tool wherein the dirt removal portion of the tool is in its deployed active working position and threaded or attached over the spike wrench onto the base member therewith, partly cut away.

FIG. 5 and FIG. 6 are elevational and a sectional view respectively of the footwear spike wrench and dirt removal tool (100) wherein the dirt removal portion of the tool (104) is in its deployed active position over the angled bar base member (106) of the tool. In its deployed active position, the dirt removal portion (104) is threadingly mounted over the grooved portion of the angled bar base member with the dirt removal prong exposed (134). FIG. 5 displays that the dirt removal portion (104) of the tool was placed over the spike wrench key (110) and threaded in place using the grooves (136) on the dirt removal portion (seen in FIG. 1), as well as the grooves (108) above the spike wrench key (110).

It is contemplated that the dirt removal portion of the tool (104) in its deployed active position can also be threadingly mounted to the cylindrical body handle member (102).

Figure 7:
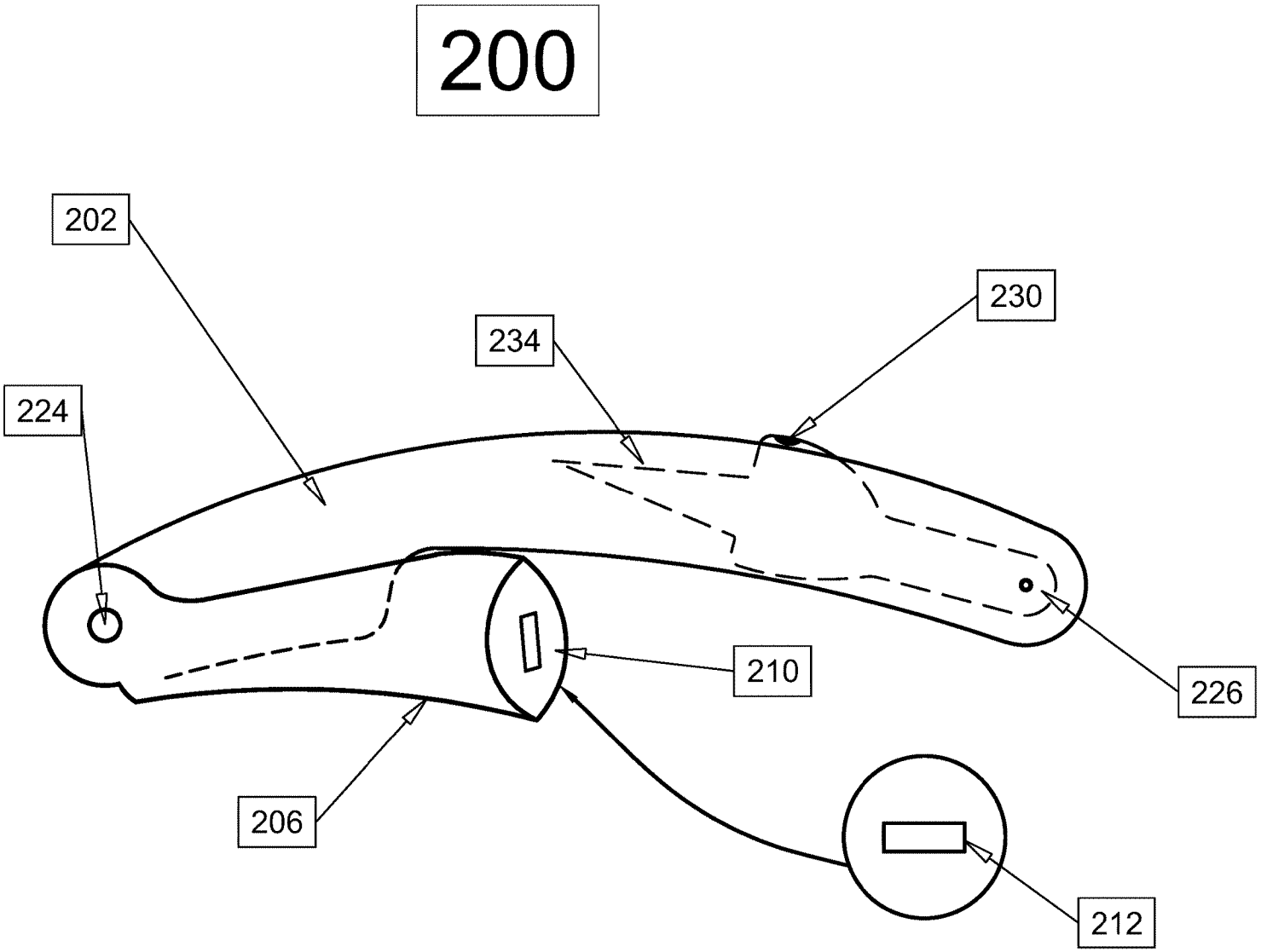
FIG. 7 is an elevational view of the footwear spike wrench and dirt removal tool with both the spike wrench key and the dirt removal prong in their stored inactive positions.

FIG. 7 illustrates an alternative form of the invention (200) wherein the tool pictured comprises of a slightly rounded bar that acts as a handle member (202). On the bottom of the tool connected to a hinge (226) is the dirt removal prong (234). In this figure, the dirt removal prong (234) is seen in its stored inactive position, folded into the device. Along the dirt removal prong (234), resides an indented prong handle (230) that allows for the dirt removal prong (234) to be easily moved from the stored inactive position to the deployed active position. On the other end of the footwear spike wrench and dirt removal tool and connected to another hinge (224) is the spike wrench key (210). In this figure, the spike wrench key (210) is seen in its resting position, folded into the device. The spike wrench key (210) is a cylindrical appendage (206) from which the spike wrench keyhole can be seen from the bottom. In the image adjacent to the bottom of the spike wrench key (212), a closer view at the rectangular shape of the spike wrench keyhole can be seen.

Figure 8:
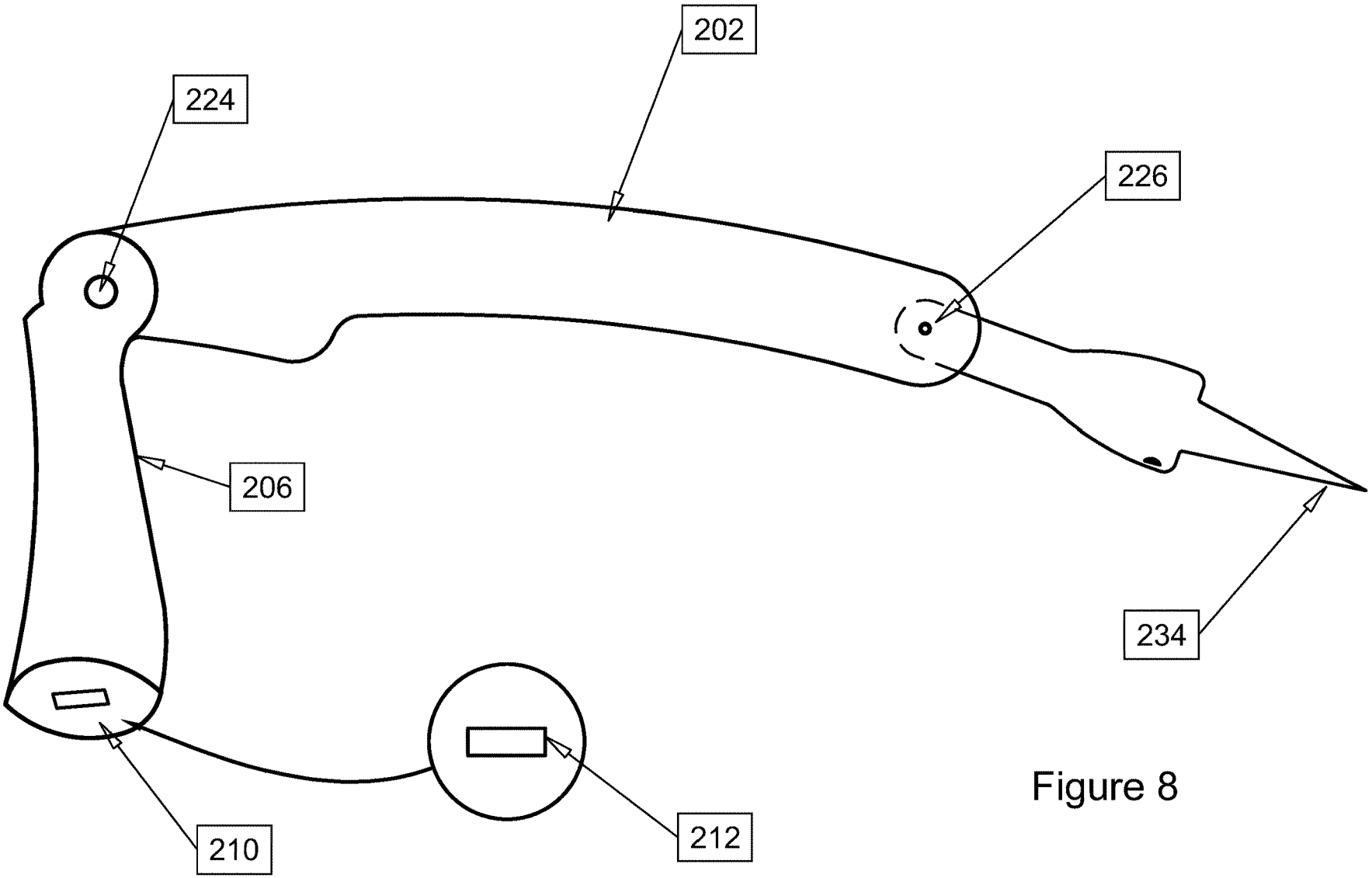
FIG. 8 is an elevational view of the footwear spike wrench and dirt removal tool with the spike wrench key at its full 90-degree extension relative to the handle, and the dirt removal prong portion at its full 180-degree extension relative to the handle.
Figure 9:
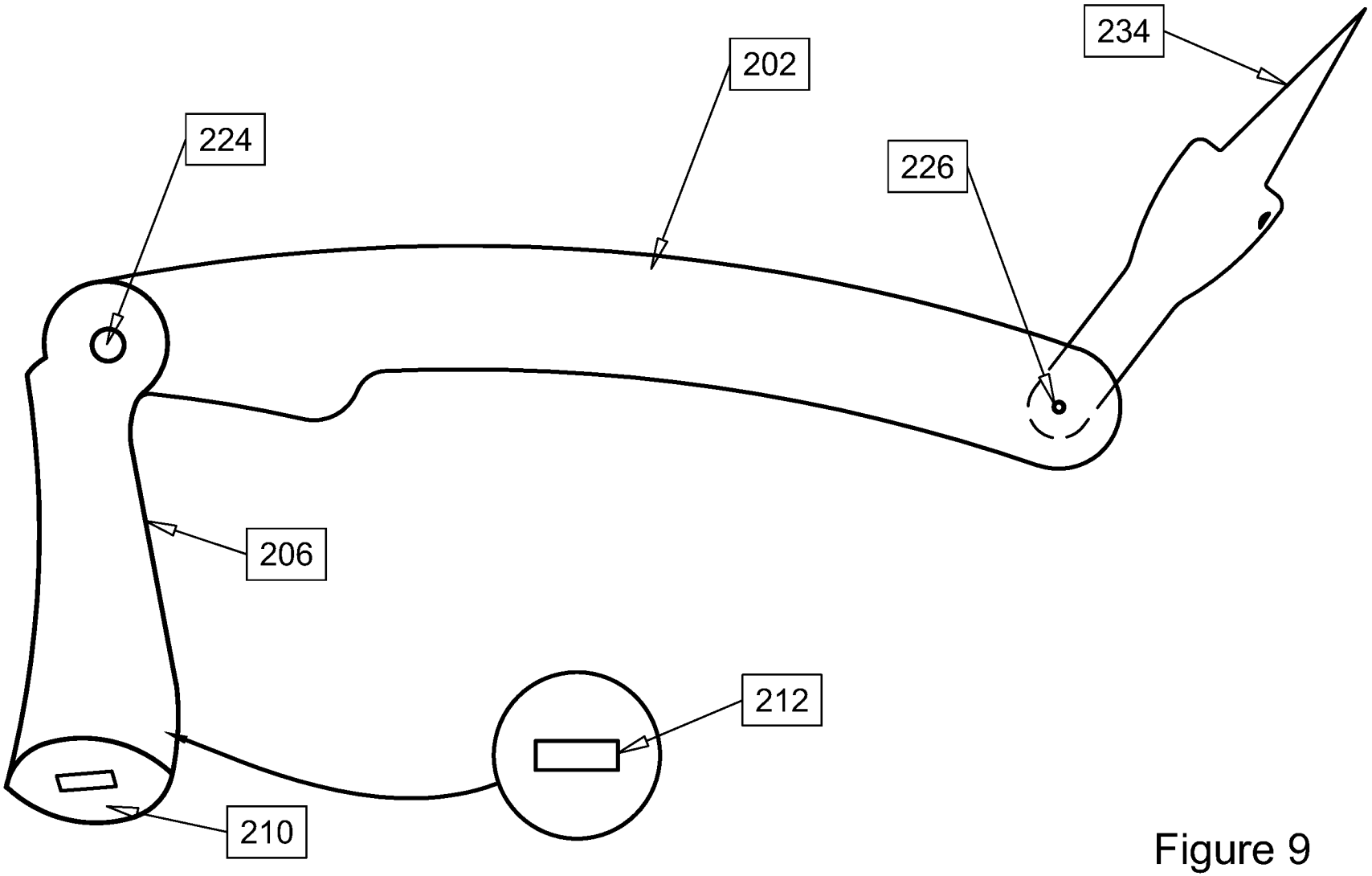
FIG. 9 is an elevational view of the footwear spike wrench and dirt removal tool with both the spike wrench key and the dirt removal prong extended at a 90-degree angle relative to the handle of the tool.

FIG. 8 and FIG. 9 are elevational views of the alternative form of the invention (200). The tool pictured comprises of a slightly rounded bar that acts as a handle member (202). On the bottom of the footwear spike wrench and dirt removal tool, connected to a hinge (226) and unfolding from the device is a dirt removal prong (234). The dirt removal prong is at its full extension in FIG. 8 and is pointed outward at a 180-degree angle relative to the handle member (202) when it is unfolded. In FIG. 9, the dirt removal prong is seen extended and locked in one of its two deployed active positions, this one being at 90-degree angle relative to the handle. On the other side of the spike wrench another hinge (224) is connected to the bar (202) and extending from it is the spike wrench key (210). The spike wrench key is at its full extension, at about 90 degrees relative to the handle member (202). The spike wrench key (210) is a cylindrical appendage (206) from which the spike wrench keyhole can be seen from the bottom. In the image adjacent to the bottom of the spike wrench key (212), a closer view at the rectangular shape of the spike wrench keyhole can be seen.

Figure 10:
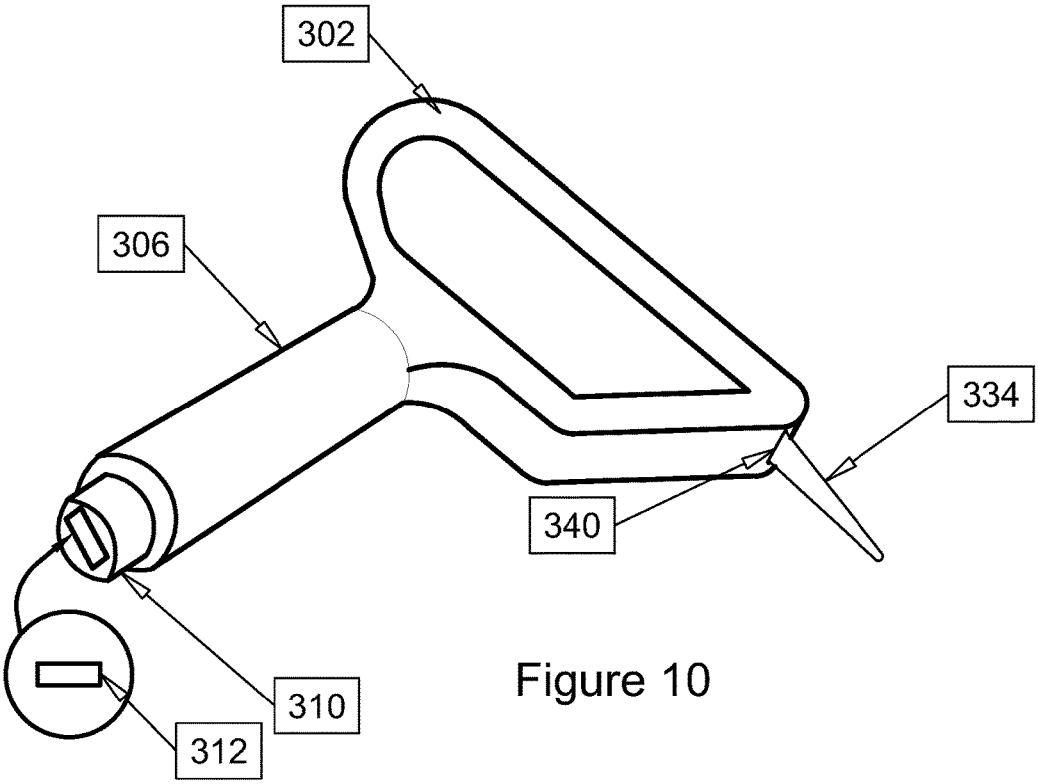
FIG. 10 is a perspective view of the footwear spike wrench and dirt removal tool. In this figure the trapezoidal body is seen with the dirt removal prong in the extended or deployed active position.

FIG. 10 is a perspective view of even another alternative form of the invention of the footwear spike wrench and dirt removal tool (300). The trapezoidal handle member (302) is seen with the dirt removal prong (334) in the deployed active position. In this figure, the dirt removal prong's exit hole (340) from which it can extend and retract is visible. Below the handle member (302), the cylindrical angled bar base member (306) leads to the 5 spike wrench key (310). At the bottom of the angled cylindrical bar base member (306) the spike wrench key (310) can be seen. Within the spike wrench key, the distinct rectangular shape (312) of the key allows it to remove spikes from the bottom of cross country runner's footwear.

Figure 11:
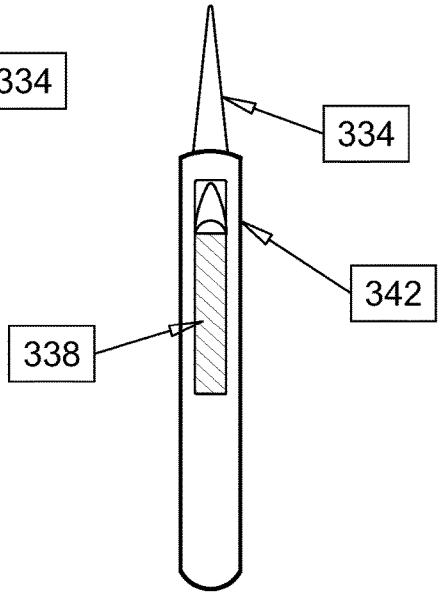
FIG. 11 is a plan view of the footwear spike wrench and dirt removal tool. In this figure, the dirt removal prong can be seen in the extended or deployed active position.

FIG. 11 is a plan view of even another alternative form of the invention (300). In this view, the dirt removal prong (334) is seen in the deployed active position. In the center of the figure, a thumb slider track (338) stretches across the top half of the handle member, and the manual thumb slider (342) is pushed to the edge of the handle member along the track, putting the dirt removal prong (334) in the deployed active position.

Figure 12:
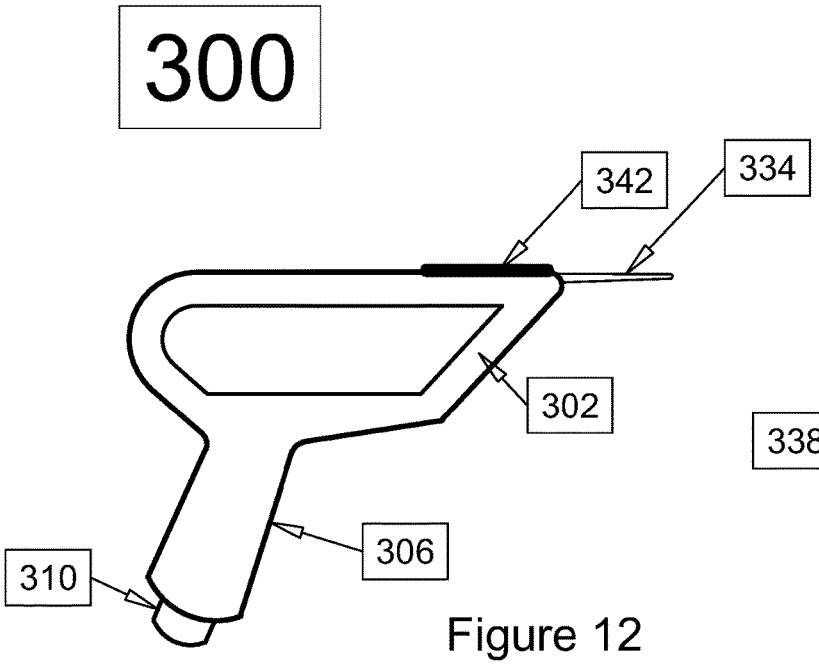
FIG. 12 is an elevational view of the footwear spike wrench and dirt removal tool. In this figure the trapezoidal body is seen with the dirt removal prong in the extended or deployed active position.

FIG. 12 is an elevational view of the footwear spike wrench and dirt removal tool (300). It has a trapezoidal body (302). On the right side of the tool the dirt removal prong (334) is seen extended from the body, with its connected manual thumb slider (342) on top of the body. Below the body is an angled cylindrical bar base member (306) that leads to the bottom of the tool, which has the spike wrench key (310).

Figure 14:
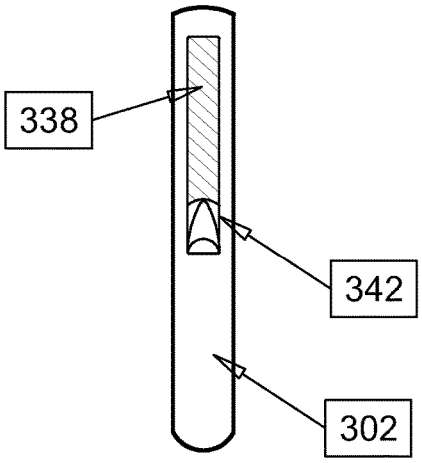
FIG. 14 is a plan view of the footwear spike wrench and dirt removal tool. In this figure the dirt removal prong can be seen in the retracted or stored inactive position.
Figure 13:
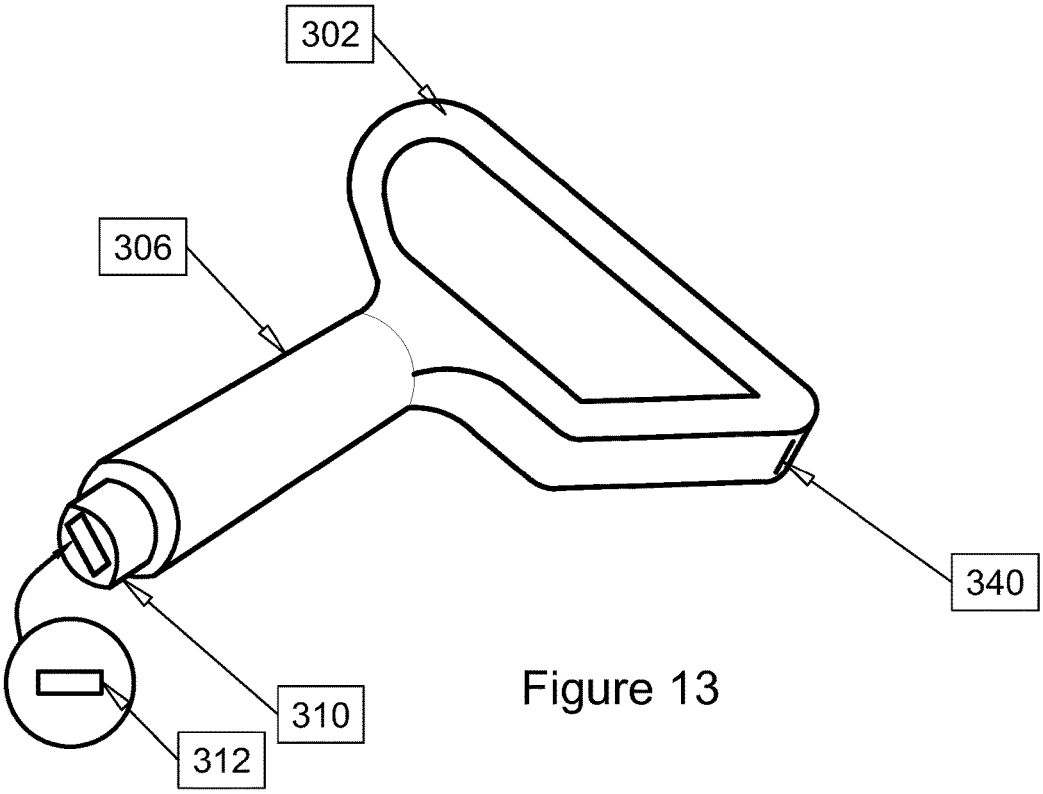
FIG. 13 is a perspective view of the footwear spike wrench and dirt removal tool. In this figure the trapezoidal body is seen with the dirt removal prong in the retracted or stored inactive position.

FIG. 13 is a perspective view of the footwear spike wrench and dirt removal tool (300). The trapezoidal body (302) is seen when the dirt removal prong is retracted and in its stored inactive position. In this figure, the dirt removal prong's exit hole (340) from which it can extend and retract is visible. Below the handle member, the cylindrical angled bar base member (306) leads to the spike wrench key (310). At the bottom of the angled bar base member, the spike wrench key (310) can be seen. Within the spike wrench key, the distinct rectangular shape of the key (312) allows the key to remove spikes from the bottom of cross country runner's footwear. FIG. 14 is an overhead view of the footwear spike wrench and dirt removal tool (300). In this view the dirt removal prong is in its stored inactive position within the tool. In the center of the figure, a thumb slider track (338) stretches across the top half of the handle member, and the manual thumb slider (342) is pushed back along the track, retracting the dirt removal prong and leaving it in the inactive position.

Figure 15:
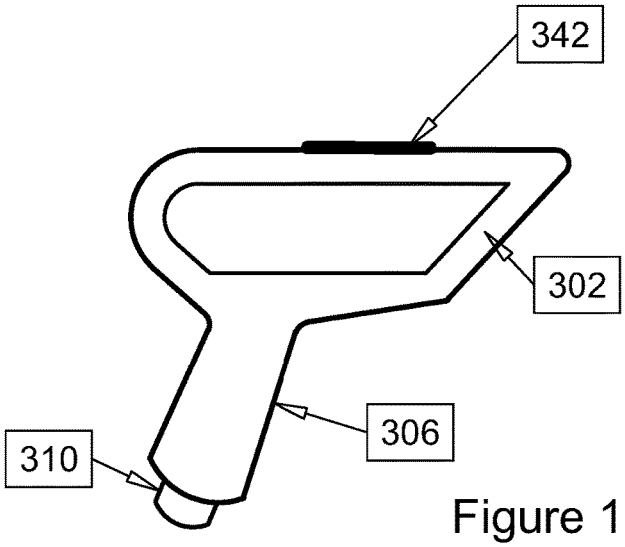
FIG. 15 is an elevational view of the footwear spike wrench and dirt removal tool. In this figure the trapezoidal body is seen with the dirt removal prong in the retracted or stored inactive position.

FIG. 15 is an elevational view of the footwear spike wrench and dirt removal tool (300). It has a trapezoidal body (302). On top of the body of the tool the manual thumb slider (342) is visible. In this figure it is pushed back along its track retracting the dirt removal prong and leaving it in its inactive position. Below the body is an angled cylindrical bar base member (306) that leads to the bottom of the tool, which has the spike wrench key (310).

Figures 16, 17:
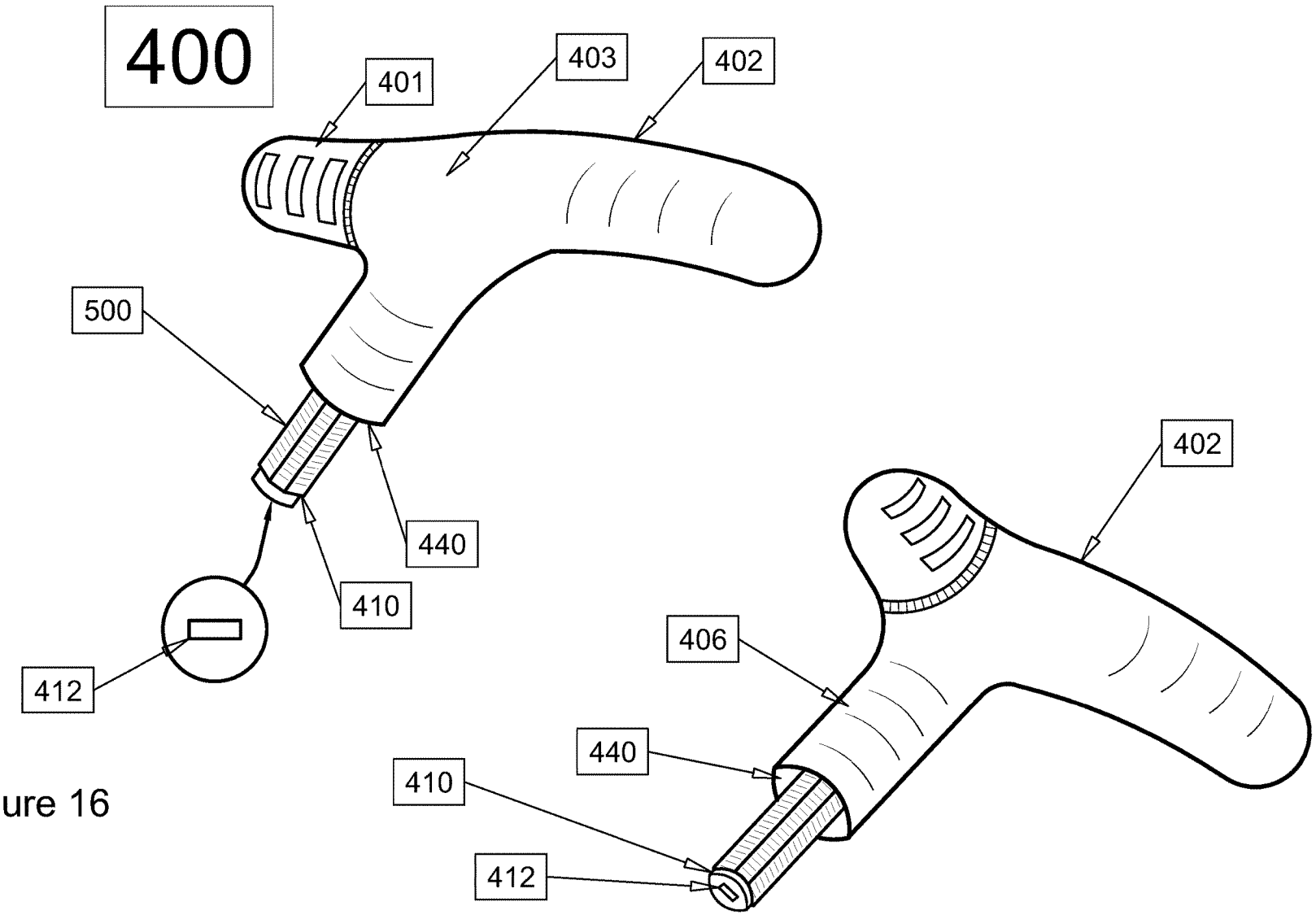
FIG. 16 and FIG. 17 is an elevational and perspective view respectively of the footwear spike wrench and dirt removal tool where the spike wrench and dirt removal prong are on one body, where this body is a bit. In this figure the dirt removal prong is in its stored inactive position while the spike wrench is in an operable position and attached to the base member sleeve via a snap-fit.

FIG. 16 and FIG. 17 is an elevational and perspective view respectively of the footwear spike wrench and dirt removal tool (400). In this figure the dirt removal prong is in its stored inactive position. The top of the figure is the cylindrical body (402) in which there is a cap (401) configured to selectively seal and unseal an internal compartment allowing access to storage area (403) within the cylindrical body (402). Extending from the handle member is an angled cylindrical bar base member (406) leading to the base member sleeve insertion point (440) for the body of the combined dirt removal prong and spike wrench key bit (500). In this figure the combined dirt removal prong and spike wrench key bit (500) is seen protruding from the base member sleeve insertion point (440). The visible end of the bit (500) is the spike wrench key (410). Next to the spike wrench key, a smaller image shows the rectangular shape of the spike wrench key (412), designed to remove spikes from cross country runner's footwear.

Figures 18, 19:
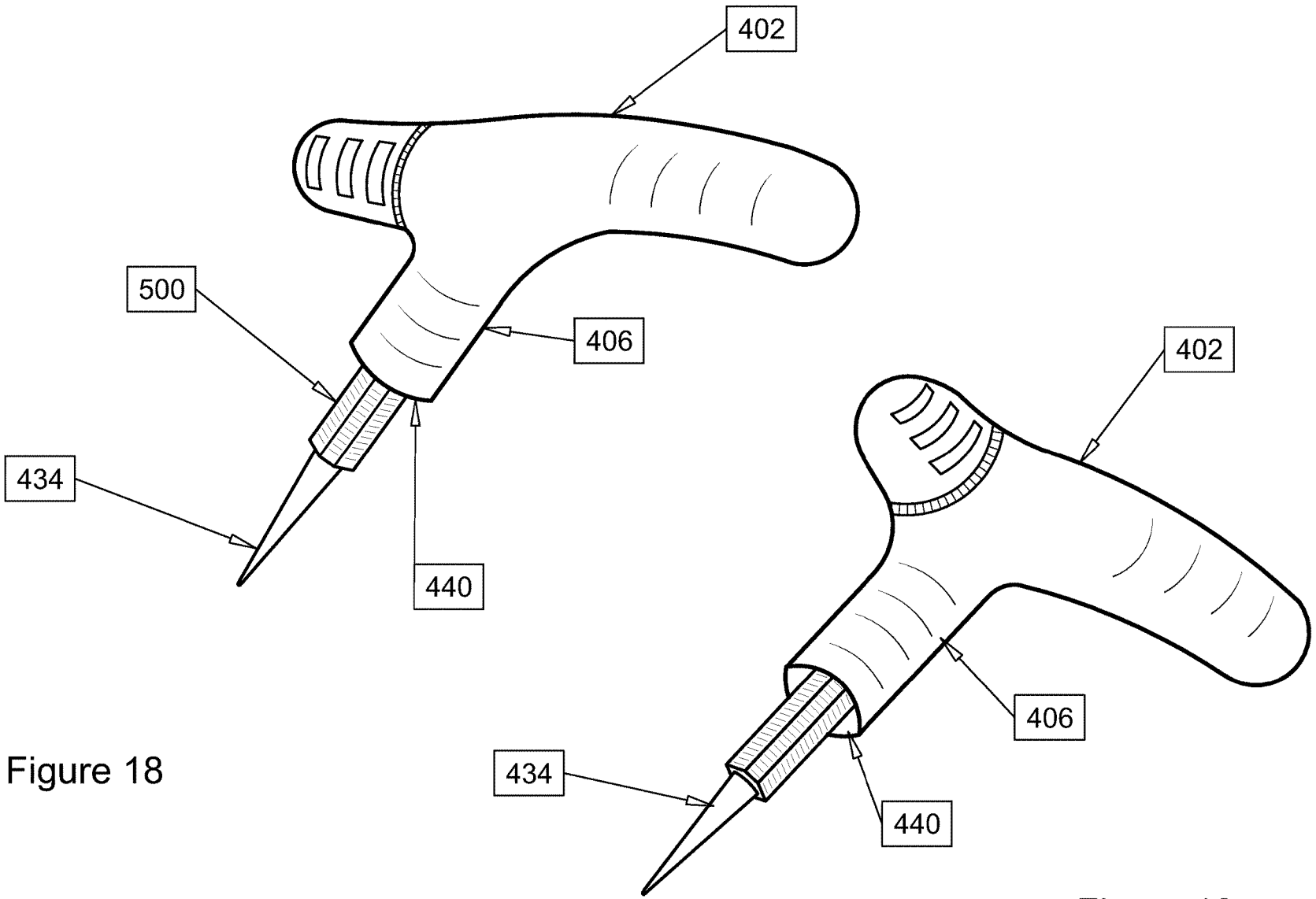
FIG. 18 and FIG. 19 is an elevational and perspective view respectively of the footwear spike wrench and dirt removal tool where the spike wrench and dirt removal prong are on one body, where this body is a bit. In this figure the dirt removal prong is in its deployed active position but the spike wrench in an inoperable position and attached to the base member sleeve via a snap-fit.

FIG. 18 and FIG. 19 is an elevational and perspective view respectively of the footwear spike wrench and dirt removal tool (400). In this figure the dirt removal prong (434) is in its deployed active position. At the top of the figure is the cylindrical body handle member (402) and extending from the body is an angled cylindrical bar base member (406) leading to the base member sleeve insertion point (440) for the body of the combined dirt removal prong and spike wrench key bit (500). In this figure, the dirt removal prong (434) is seen protruding from the base member sleeve insertion point. It has been switched to the deployed active position as a result of the removal and reversal of the combined dirt removal prong and spike wrench key bit (500).

Figures 20, 21:
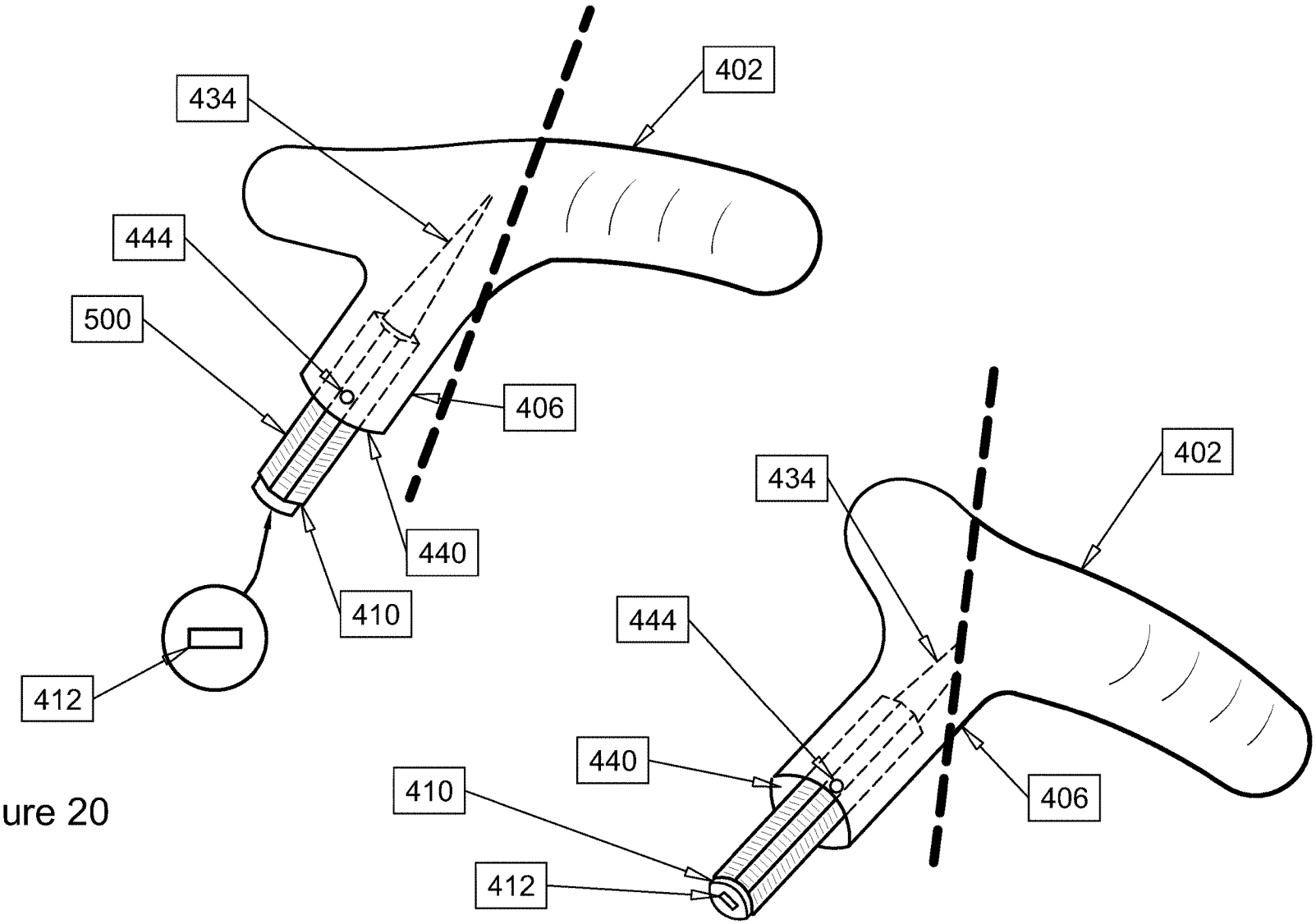
FIG. 20 and FIG. 21 is a sectional elevational and perspective view respectively of the footwear spike wrench and dirt removal tool where the spike wrench and dirt removal prong are on one body, where this body is a bit. In this figure the dirt removal prong is in its stored inactive position while the spike wrench is in an operable position and attached to the base member sleeve via a snap-fit.

FIG. 20 and FIG. 21 is a sectional elevational and perspective view respectively of the footwear spike wrench and dirt removal tool (400). In this figure, the dirt removal prong (434) is in its stored inactive position, leaving the spike wrench key (410) portion of the bit (500) protruding from the base member sleeve insertion point (440). On the opposite end of the combined dirt removal prong and spike wrench key bit (500), the dirt removal prong (434) rests in a locked position within the angled cylindrical bar base member (406). Along the surface of the combined dirt removal prong and spike wrench key bit (500), a small locking mechanism in the shape of a circle (444) that is similar to a socket adapter is visible. This locking mechanism aids in securing the combined dirt removal prong and spike wrench key bit (500) in place when it is inserted into the base member sleeve insertion point (440). Next to the spike wrench key (410), a smaller image shows the shape of the spike wrench key (412), designed to install and remove spikes from cross country runner's footwear.

Figures 22, 23:
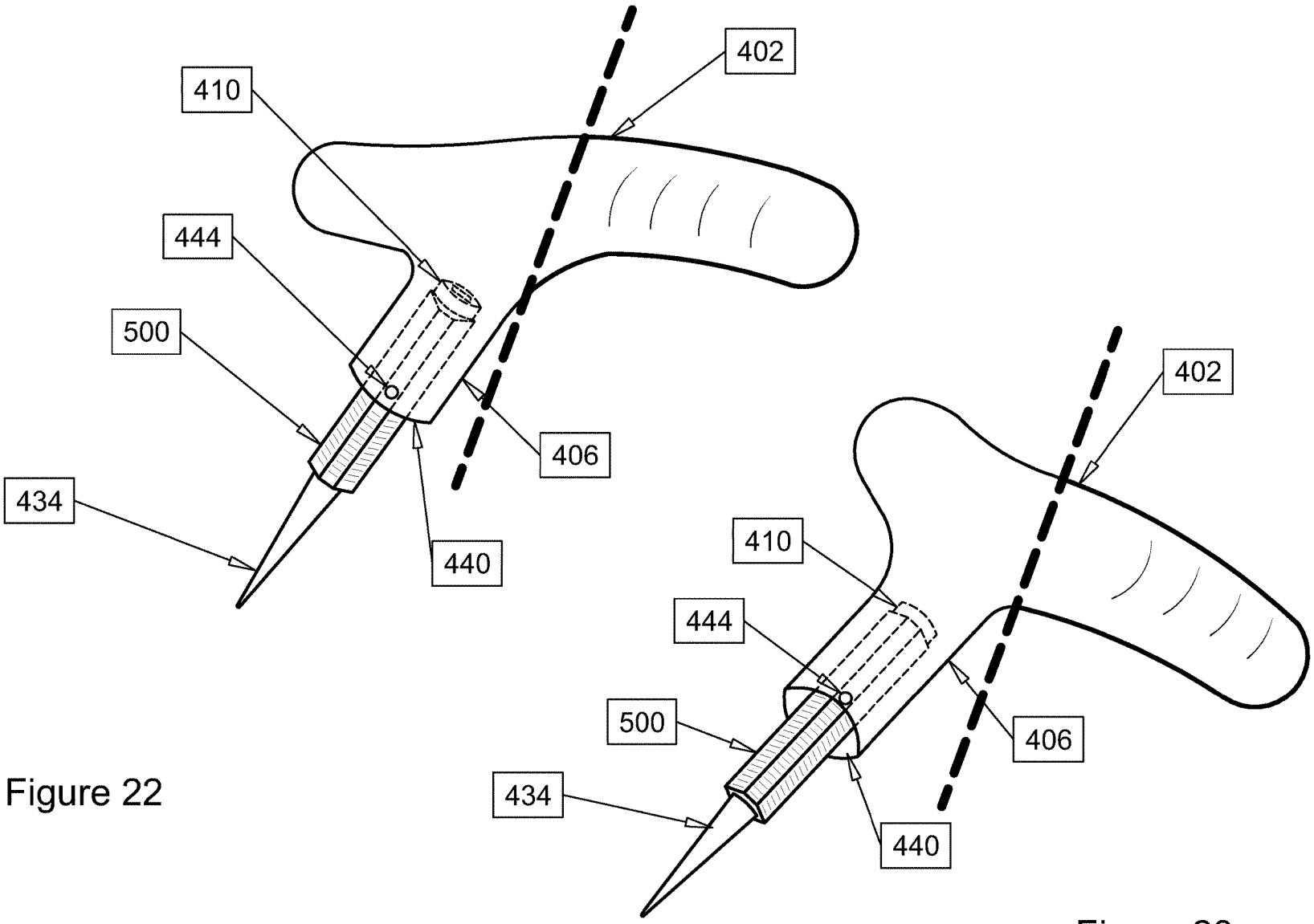
FIG. 22 and FIG. 23 is a sectional elevational and perspective view respectively of the footwear spike wrench and dirt removal tool where the spike wrench and dirt removal prong are on one body, where this body is a bit. In this figure the dirt removal prong is in its deployed active position but the spike wrench in an inoperable position and attached to the base member sleeve via a snap-fit.

FIG. 22 and FIG. 23 is a sectional elevational and perspective view respectively of the footwear spike wrench and dirt removal tool (400). In this figure the dirt removal prong (434) is in its deployed active position protruding from the base member sleeve insertion point of the device (440). In this figure the cylindrical body handle member (402) is seen at the top, and within the angled cylindrical bar base member (406) the opposite end of the combined dirt removal prong and spike wrench key bit (500) is seen, which is the spike wrench key (410). Along the surface of the combined dirt removal prong and spike wrench key bit (500), a small locking mechanism in the shape of a circle (444) that is similar to a socket adapter is visible. This locking mechanism aids in securing the combined dirt removal prong and spike wrench key bit (500) in place when it is inserted into the base member sleeve insertion point (440).

Figures 24, 25:
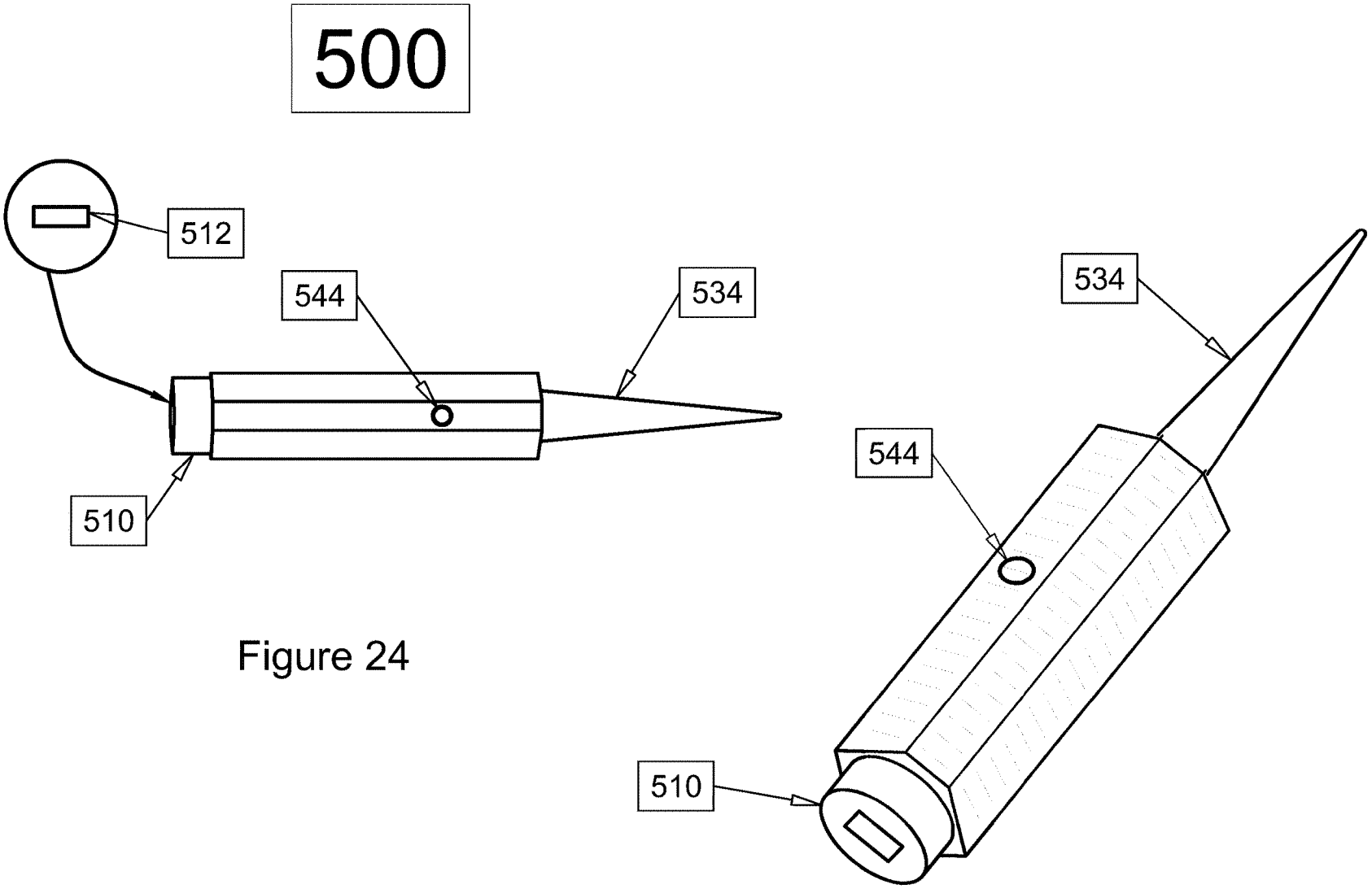
FIG. 24 and FIG. 25 is an elevational and perspective view respectively of the combined dirt removal prong and spike wrench key body, where this body is a bit that can be placed within the footwear spike wrench and dirt removal tool base member's sleeve.

FIG. 24 and FIG. 25 is an elevational and perspective view respectively for the body of the combined dirt removal prong and spike wrench key bit (500) that can be inserted into base member sleeve insertion point (440) of the footwear spike wrench and dirt removal tool (400). On the first body end of the bit, the spike wrench key is seen (510). The spike wrench key is on the end of the body portion of the bit (500) and has a smaller circumference than the body to allow the bit to fit and lock into the insertion point (440) of the tool. An image shows the shape of the spike wrench key (512), designed to remove spikes from footwear. On the second body end of the bit, the dirt removal prong is seen (534). Along the body of the bit, a locking mechanism (544) in the shape of a circle that is similar to a socket adapter allows the bit to be secured within the angled cylindrical bar base member sleeve insertion point (440).

Figures 26, 27:
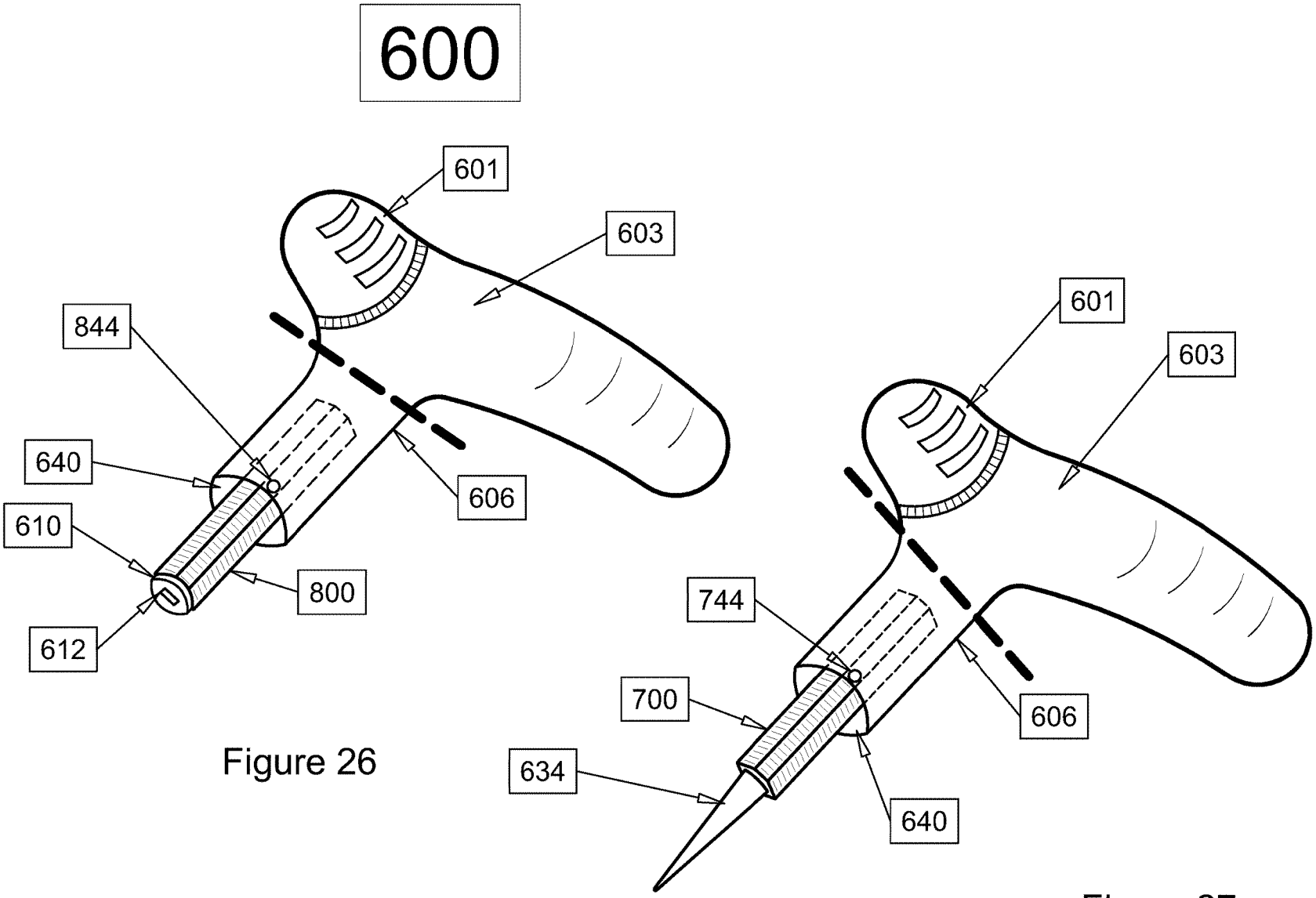
FIG. 26 and FIG. 27 is an elevational and perspective view respectively of a combined dirt removal prong and spike wrench key body, where this body is a bit that utilizes a different design for the spike wrench key that enables it to remove golf spikes. It can be placed within the footwear spike wrench and dirt removal tool base member's sleeve.
Figure 29:
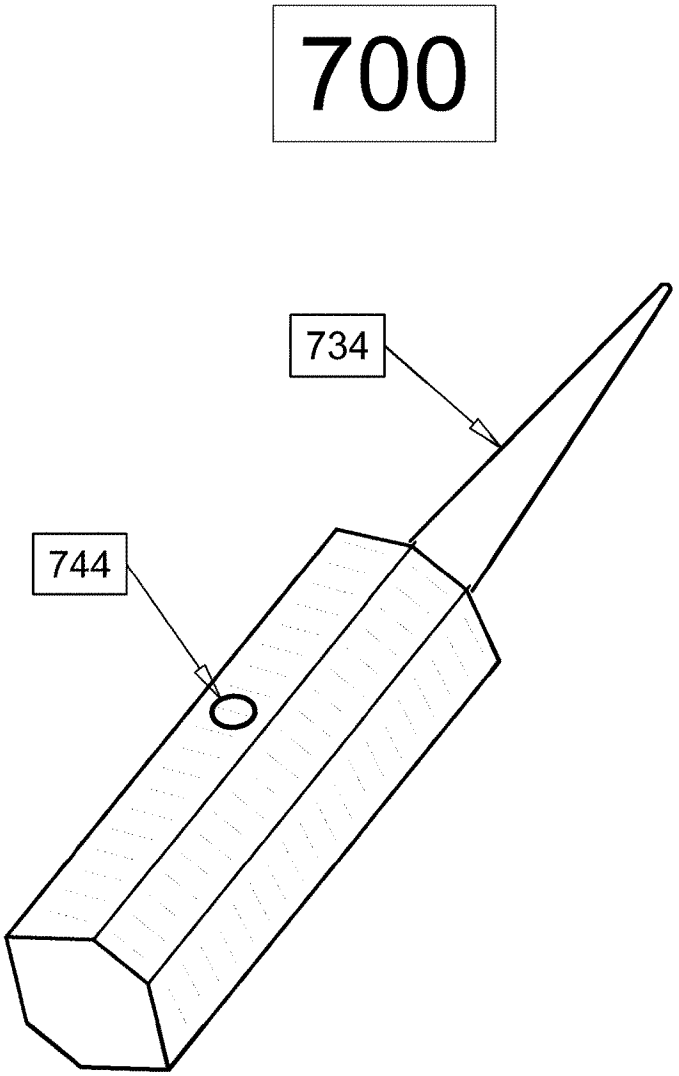
FIG. 28 and FIG. 29 is an elevational view of the footwear spike wrench and dirt removal tool where it consists of a kit with two bits where one bit is the dirt removal prong and the second bit comprises the spike wrench key.
Figure 28:
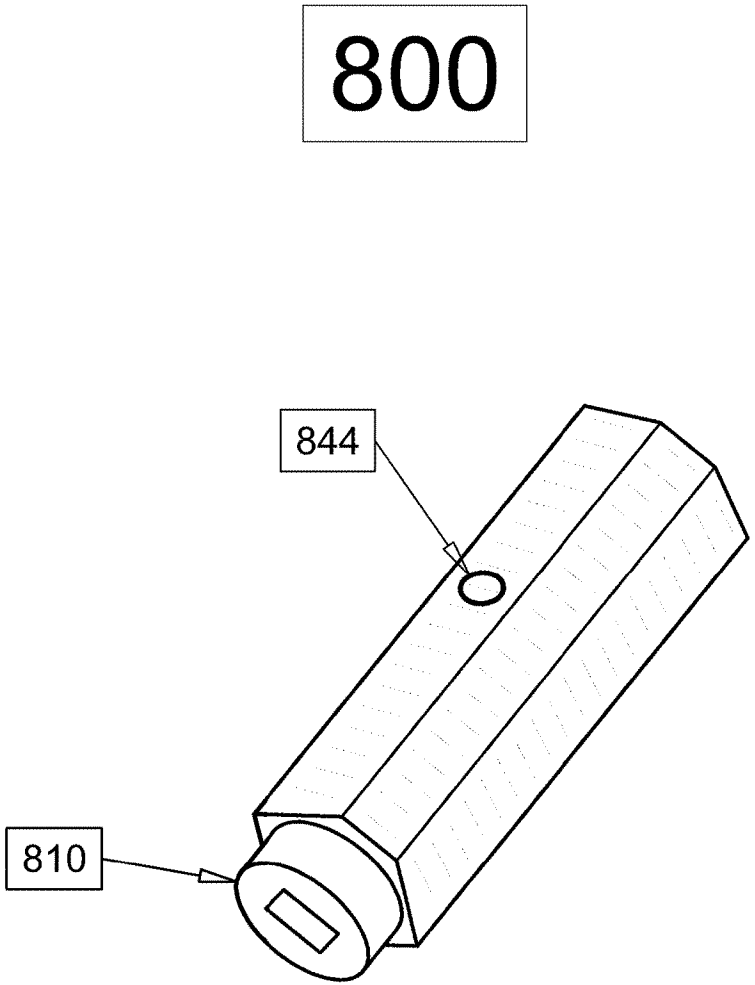

FIG. 26 and FIG. 27 is a sectional elevational view of the footwear spike wrench and dirt removal tool (600). It illustrates the tool comprising of a kit that consists of two bits FIG. 28 (800) and FIG. 29 (700): The first bit (700) is the dirt removal prong (634) in its deployed active position protruding from the base member sleeve insertion point of the device (640). The second sectional elevational view with the second bit (800), which illustrates the tool comprising the spike wrench removal key (610) in its active position protruding from the base member sleeve insertion point of the device (640).

Along the surface of bits (700) and (800), a locking mechanism in the shape of a circle (744) and (844) that is similar to a socket adapter is visible. This locking mechanism aids in securing the bits (700) and (800) in place when it is inserted into the base member sleeve insertion point (640). When the dirt removal prong and the spike wrench are not in use, they can be stored by removing the cap (601) and keeping them in the storage compartment (603).

Figure 31:
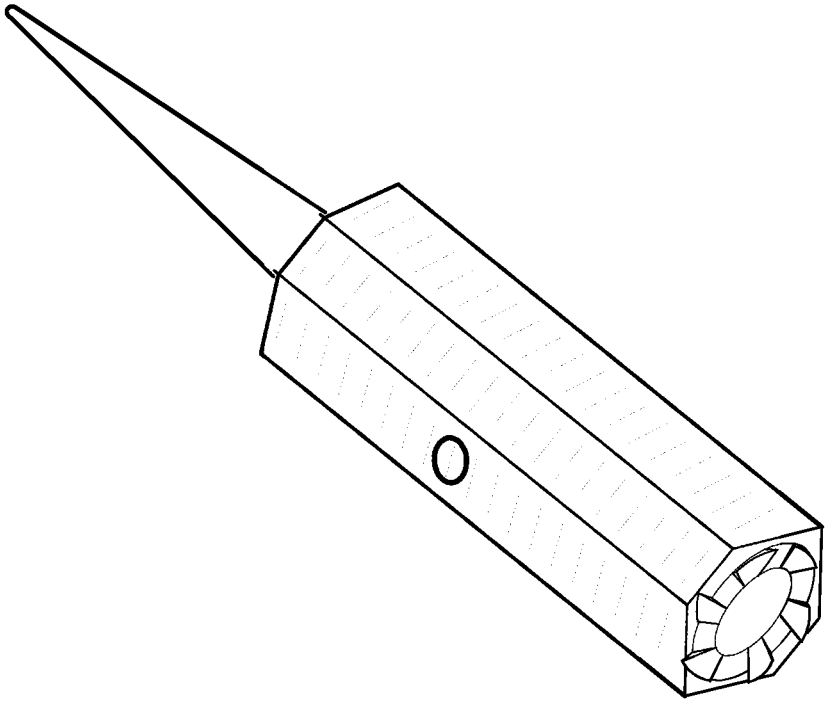
FIG. 30 and FIG. 31 is an elevational and perspective view respectively of a combined dirt removal prong and spike wrench key bit that utilizes a different design for the spike wrench key that enables it to remove golf spikes.
Figure 30:
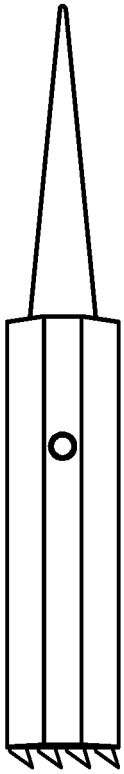

FIG. 30 and FIG. 31 are elevational and perspective views, respectively of a combined dirt removal prong and spike wrench key bit that utilizes a different design for the spike wrench key that enables it to remove golf spikes. This spike wrench and dirt removal tool can be utilized to remove grass and dirt that accumulates in the spikes. The unique sharp and pointed structure of the prong, when deployed in the active position, allows for easy removal of the dirt. Golf spikes do get worn out from time to time and when the spikes and bottom soles of the golf shoes have been cleaned, the same tool can be utilized to remove and attach new golf spikes to the golf shoes.

The cross country spike wrench and dirt removal tool is a multipurpose tool that combines the universal cross country spike key and a dirt remover prong into one. The novel design allows for the sharp and pointed structure of the prong to be in a safe stored inactive position when the spike key is being utilized to attach or remove spikes. However, the prong can be deployed within the tool when there is a need to remove dirt from the bottom of the shoes or spikes. The cross country spike wrench and dirt removal tool is also equipped with a storage compartment that is sealed with a removable cap. This storage compartment is ideal for storing spikes. As mentioned, cross country runner typically carry an additional set of spikes with different lengths. When a runner arrives at the race, the runner installs spikes that are most appropriate for the terrain they will be running on. Today, these spikes are brought to the race in small zip-lock bags. However, the spike wrench and dirt removal tool with a compartment allows runners to store their additional spikes within the storage compartment of the tool for ease in carrying spikes. For Cross Country runners, the tool allows for the easy removal of dirt from the bottom of the shoe, as well as a spike key for installation and removal of the spikes and a storage compartment to store their spikes.

The "all-in-one" concept of the tool is not limited to cross country footwear; it can be applied to any sports footwear which accommodates removable spikes around which dirt, sand or other debris can accumulate. For example, a spike wrench and dirt remover tool configured for golf shoes may include a standard golf spike wrench that is utilized to attach and remove golf spikes and an integrated dirt removal prong that can deployed to an active and inactive position. This spike wrench and dirt removal tool can be utilized to remove grass and dirt that accumulates in the spikes. Golf spikes do get worn out from time to time and when the spikes and bottom soles of the golf shoes have been cleaned, the same tool can be utilized to remove and attach new golf spikes to the golf shoes.

What is claimed is:

1. An all-in-one footwear spike wrench and dirt removal tool comprising:

a. a handle member having a first handle end, an internal compartment formed in said first handle end with a sealable opening that opens to an outer surface of said handle member, a removable cap covering said sealable opening, and a second handle end opposite said first handle end;

b. a base member having a sleeve formed therein connected to said handle member;

c. a footwear dirt removal prong having a body portion with a dirt removal tool terminal end portion, said footwear dirt removal prong being removably attachable to said second handle end or to said base member and adjustable between a stored position in which said dirt removal tool terminal end portion is inoperative and a deployed position in which said dirt removal tool terminal end portion is operative;

d. a footwear spike wrench key protruding from said footwear dirt removal prong body portion opposite said dirt removal tool terminal end portion; and e. in said stored position, said dirt removal tool terminal end portion is received into said sleeve in said base member and said footwear spike wrench key is exposed and operative, and in said deployed position, said dirt removal tool terminal end portion is exposed and operative and said footwear spike wrench key is received into said sleeve in said base member and is inoperative.

2. The all-in-one footwear spike wrench and dirt removal tool of claim 1, wherein, in both the stored position and the deployed position, said footwear dirt removal prong is attached to said handle member second end or to said base member end by a snap-fit.

3. The all-in-one footwear spike wrench and dirt removal tool of claim 1, wherein, in both the stored position and the deployed position, said footwear dirt removal prong is threadingly attached to said second handle end or to said base member end.

4. The all-in-one footwear spike wrench and dirt removal tool of claim 1, further comprising a locking mechanism having corresponding lock elements in said base member sleeve and on said footwear dirt removal prong operative to hold said footwear dirt removal prong within said base member sleeve in said stored position and in said deployed position.

5. The all-in-one footwear spike wrench and dirt removal tool of claim 1, wherein said dirt removal tool terminal end portion is tapered to have a cross-sectional area that decreases in a direction from said body portion to a terminus of said dirt removal tool terminal end portion.

6. The all-in-one footwear spike wrench and dirt removal tool of claim 5, wherein said dirt removal tool terminal end portion is made of metal and has a length of between 3 cm and 5 cm, a width adjacent said body portion of between 5 mm and 10 mm, and a maximum cross-sectional area of 5 $mm^2$.

7. The all-in-one footwear spike wrench and dirt removal tool of claim 1, wherein said footwear spike wrench key has a configuration corresponding to a configuration required to install and remove spikes attached to cross country shoes.

8. The all-in-one footwear spike wrench and dirt removal tool of claim 7, wherein said footwear spike wrench key has a rectangular configuration.

9. The all-in-one footwear spike wrench and dirt removal tool of claim 7, wherein said internal compartment in said first handle end is sized to hold at least twelve standard cross-country shoe spikes.

10. The all-in-one footwear spike wrench and dirt removal tool of claim 1, wherein said footwear spike wrench key has a configuration corresponding to a configuration required to install and remove spikes attached to golf shoes.

11. An all-in-one footwear spike wrench and dirt removal tool comprising:

a. a handle member having a sleeve formed therein;

b. a base member connected to said handle member with a footwear spike wrench key attached to an end of said base member;

c. a footwear dirt removal prong attached to at least one of the handle member or the base member having a body portion with a first body end and a second body end and a terminal end tool portion configured to remove dirt from a vicinity of a footwear spike protruding from said first body end; and d. said footwear dirt removal prong is connected to said handle member to be adjustable between a stored position with said terminal end tool portion received into said sleeve and inoperative and said second body end exposed, and a deployed position with said terminal end tool portion exposed and operative and said second body end facing said sleeve or a deployed position with said body portion mounted over said footwear spike wrench key.

12. The all-in-one footwear spike wrench and dirt removal tool of claim 11, wherein said footwear dirt removal prong is threadedly mounted to said handle member in both said stored position and in said deployed position.

13. The all-in-one footwear spike wrench and dirt removal tool of claim 11, wherein said footwear dirt removal prong is threadedly mounted to said handle member in said stored position, and said footwear dirt removal prong is threadedly mounted to said base member in said deployed position.

14. The all-in-one footwear spike wrench and dirt removal tool of claim 11, wherein in said stored position, said terminal end tool portion is received into said handle member sleeve with said second body end exposed and said terminal end tool portion is inoperative, and in said deployed position, said footwear dirt removal prong body portion is mounted over said footwear spike wrench key with said terminal end tool portion exposed and operative so that said footwear spike wrench is inoperative.

15. The all-in-one footwear spike wrench and dirt removal tool of claim 11, wherein said footwear spike wrench key has a rectangular configuration corresponding to a configuration required to attach spikes to and remove spikes from cross country shoes.

16. The all-in-one footwear spike wrench and dirt removal tool of claim 11, wherein said base member is hingedly connected to said handle member, said footwear dirt removal prong is hingedly connected to said handle member, said sleeve in said handle comprises a slot formed in said handle member, and said terminal end tool portion is pivotable between the stored position, with said terminal end tool portion at least partially received in said slot, and two lockable deployed operative positions comprising angles of 90 degrees and 180 degrees between said terminal end tool portion and said handle member, wherein said footwear spike wrench key is configured to engage and remove correspondingly configured spikes on a type of sports footwear.

17. The all-in-one footwear spike wrench and dirt removal tool of claim 11, wherein said handle member has a substantially trapezoidal configuration with a planar longitudinal portion, said sleeve is located in said upper longitudinal portion, said footwear dirt removal prong is mounted within said sleeve to move between the inoperative stored position with said terminal end tool portion retracted and stored within said sleeve and the operative deployed position with said terminal end tool portion extended from said upper longitudinal portion, and a manually activated slider mechanism in said upper longitudinal portion operative to move said dirt removal prong between said extended operative deployed position and said retracted inoperative stored position, wherein said footwear spike wrench key is configured to engage and remove correspondingly configured spikes on a type of sports footwear.

* * * * *